US006402631B1

(12) United States Patent
Gembarowicz

(10) Patent No.: US 6,402,631 B1
(45) **Date of Patent: *Jun. 11, 2002**

(54) SWING SET GOLF NET AND METHOD FOR CONVERTING A SWING SET INTO A GOLF BALL BACKSTOP

(76) Inventor: Mary Jane Gembarowicz, 249 Belknap Rd., Framingham, MA (US) 01701

( * ) Notice: Subject to any disclaimer, the term of this patent is extended or adjusted under 35 U.S.C. 154(b) by 0 days.

This patent is subject to a terminal disclaimer.

(21) Appl. No.: 09/414,102

(22) Filed: Oct. 7, 1999

Related U.S. Application Data

(63) Continuation-in-part of application No. 09/303,925, filed on May 3, 1999, now Pat. No. 6,200,235.

(51) Int. Cl.[7] ..... A63B 9/36
(52) U.S. Cl. ..... 473/197; 472/118
(58) Field of Search ..... 273/398–402; 473/197, 478; 472/118–125

(56) References Cited

U.S. PATENT DOCUMENTS 4,045,032 A * 8/1977 Cox ..... 473/197
4,116,446 A * 9/1978 Thompson ..... 473/197
4,723,780 A * 2/1988 Vinzetta ..... 473/197
4,969,651 A * 11/1990 Comartin ..... 473/197
5,088,740 A * 2/1992 Peterson ..... 473/197
5,180,167 A * 1/1993 Felix ..... 473/197
5,524,901 A * 6/1996 Bison et al. ..... 473/197
5,664,784 A * 9/1997 Redlich et al. ..... 473/197
5,730,442 A * 3/1998 Anderson ..... 473/197
5,839,733 A * 11/1998 Meeks et al. ..... 273/400
5,842,939 A * 12/1998 Pui et al. ..... 273/400
5,876,291 A * 3/1999 Dubose ..... 473/197
5,954,600 A * 9/1999 Gill ..... 473/478
6,200,235 B1 * 3/2001 Gembarowicz ..... 473/476

* cited by examiner

*Primary Examiner*—Mark S. Graham
(74) *Attorney, Agent, or Firm*—Mirick, O'Connell, DeMallie & Lougee, LLP

(57) ABSTRACT

A net set for a swing set and method for attaching the net set which enables the swing set to be used as a golf ball backstop, comprising: a back net piece with at least two substantially vertical side edges and one substantially horizontal top edge; two side net pieces each attached to the back piece along at least one of the side edges; a net top piece attached to the back piece along the top edge; and one or more ties or straps for removably attaching one or more of the net pieces to the swing set.

1 Claim, 4 Drawing Sheets

SWING SET GOLF NET AND METHOD FOR CONVERTING A SWING SET INTO A GOLF BALL BACKSTOP

CROSS-REFERENCE

This is a continuation-in-part of U.S. application Ser. No. 09/303,925 filed on May 3, 1999 U.S. Pat. No. 6,200,235.

FIELD OF THE INVENTION

This invention relates to a net set which can be attached to a swing set to enable the swing set to be used as a golf ball backstop and a method for attaching the same.

BACKGROUND OF THE INVENTION

Golf has become a popular sport activity for children and adults alike. As the popularity of the sport has grown, so to has the number of devices available for practicing golfing skills at home. Although these devices are useful, they are just one more item to clutter up a yard, garage or basement. Of all these items, some expensive, some not, purchased over time, very few, if any, of these items are adapted for alternative uses.

Therefore, a need is identified to design a device which enables someone to practice golfing skills, especially driving skills, or any other golf skills requiring a back stop, and which serves to expand the immediate usefulness of a swing set and to extend the useful lifetime of a swing set by readily and inexpensively converting the swing set into a backstop.

SUMMARY OF THE INVENTION

It is therefore a primary object of this invention to provide a net set which can be attached to a swing set to enable the swing set to be used as a back stop for a game ball.

It is a further object of this invention to provide a net set which can be attached to a swing set to enable the swing set to be used as a golf ball backstop.

It is a further object of this invention to provide a net set adaptable for use with a variety of swing sets and attachable thereto to enable the swing sets to be used as back stops for golf balls and other game balls.

It is a further object of this invention to provide a method for converting a swing set into a golf ball backstop or other game ball back stop by attaching an adaptable net set to a swing set.

During the period when children are still using a swing set, by using the net set of the invention, the swing set can be temporarily converted to a back stop or goal for game balls, including golf balls and then easily changed back to a swing set. After the children have grown out of their backyard swing set, instead of throwing the swing set away as usually happens, the swing set can remain useful as a golf ball backstop simply by converting the swing set using the net set of the invention.

A preferred embodiment of the net set of this invention for use with a swing set which enables the swing set to be used as a golf ball backstop, comprises: a back net piece with at least two substantially vertical side edges and one substantially horizontal top edge; two side net pieces each attached to the back piece along at least one of the side edges; a net top piece attached to the back piece along the top edge; and one or more means for removably attaching one or more of the net pieces to the swing set. The net should have a weave that is tight enough to prevent a golf ball driven at a substantial force from passing through gaps in the weave of the net. Preferably, these gaps should be no more than about 1 to 1½ inches in diameter or in height/width. The side net pieces preferably have a trapezoidal-shaped perimeter with a top edge and the net top piece has a front edge, a back edge and two opposing side edges, wherein the side edges of the top piece are removably attached to the top edge of the side net pieces. The side edges of the top piece are preferably removably attached to the top edge of the side net pieces by one or more of the means for removably attaching the net pieces to the swing set.

The net set preferably comprises one or more means for anchoring one or more of the net pieces to the surface on which the swing is located and the net pieces comprise a plastic material. In addition one or more of the means for removably attaching the net pieces to the swing set may comprise a hook and loop material.

Another preferred embodiment of the net set of the invention for a swing set located on a surface which enables the swing set to be used as a backstop for a golf ball, comprises: a back net piece with at least two substantially vertical side edges and one substantially horizontal top edge; two side net pieces each attached to the back piece along at least one of the side edges; a net top piece attached to the back piece along the top edge; one or more means for removably attaching one or more of the net pieces to the swing set; and one or more means for anchoring one or more of the net pieces to the surface. Similar to the first described embodiment, the side net pieces may have a trapezoidal-shaped perimeter with a top edge and the top piece has a front edge, a back edge and two opposing side edges, wherein the side edges of the top piece are removably attached to the top edge of the side net pieces by one or more of the means for removably attaching the net pieces to the swing set.

One or more of the means for removably attaching the net pieces to the swing set may comprise a hook and loop material, rope or twine and the net pieces preferably comprise a plastic material.

Yet another preferred embodiment of the net set of the invention for a swing set which enables the swing set to be used as a golf ball backstop, comprises: a back net piece with at least two substantially vertical side edges and one substantially horizontal top edge; a plurality of side net pieces each attached to the back piece along at least one of the side edges; one or more net top pieces attached to the back piece along the top edge; and one or more means for removably attaching one or more of the side net pieces to one or more of the net top pieces and for removably attaching one or more of the net pieces to the swing set; wherein the side net pieces have a trapezoidal-shaped perimeter with a top edge; the net top piece has a front edge, a back edge and two opposing side edges and wherein the side edges of the top piece are removably attached to the top edge of the side net pieces with one or more of the means for removably attaching one or more of the side net pieces to one or more of the net top pieces. The net pieces preferably comprise a plastic material and one or more of the means for removably attaching the net pieces to the swing set preferably comprise a hook and loop material.

The net set of the invention may be designed to fit a swing set having virtually any size and shape. In addition to golf balls, the net set and method of the invention may be adapted to be a backstop to any size game ball, hockey puck or other similar objects for which a backstop may be used.

The preferred method of the invention for converting a swing set into a soccer goal or other game ball back stop by attaching a net set to the swing set, comprises the steps of: providing a swing set comprising, a central support bar having two ends; and at least one side supports on each of the ends of the central support bar; providing a net set comprising, at least one back net piece with at least two substantially vertical side edges and one substantially horizontal top edge; at least two side net pieces each attached to the back piece along at least one of the side edges; at least one net top piece attached to the back piece along the top edge; and one or more means for removably attaching one or more of the net pieces to the swing set; attaching at least two of the side net pieces to the side supports of the swing set using one or more of the means for removably attaching one or more of the net pieces to the swing set.

BRIEF DESCRIPTION OF THE DRAWINGS

Other objects, features and advantages will occur to those skilled in the art from the following description of the preferred embodiments and the accompanying drawings in which.

DETAILED DESCRIPTION OF THE PREFERRED EMBODIMENTS

The net set of the invention, which attaches to a swing set to enable the swing set to be used as a golf ball backstop, generally comprises a back net piece with two substantially vertical side edges and one substantially horizontal top edge; two side net pieces each attached to the back piece along at least one of the side edges; a net top piece attached to the back piece along the top edge; and a plurality of ties or Velcro straps for removably attaching the edges of the net pieces to the swing set.

Figure 1:
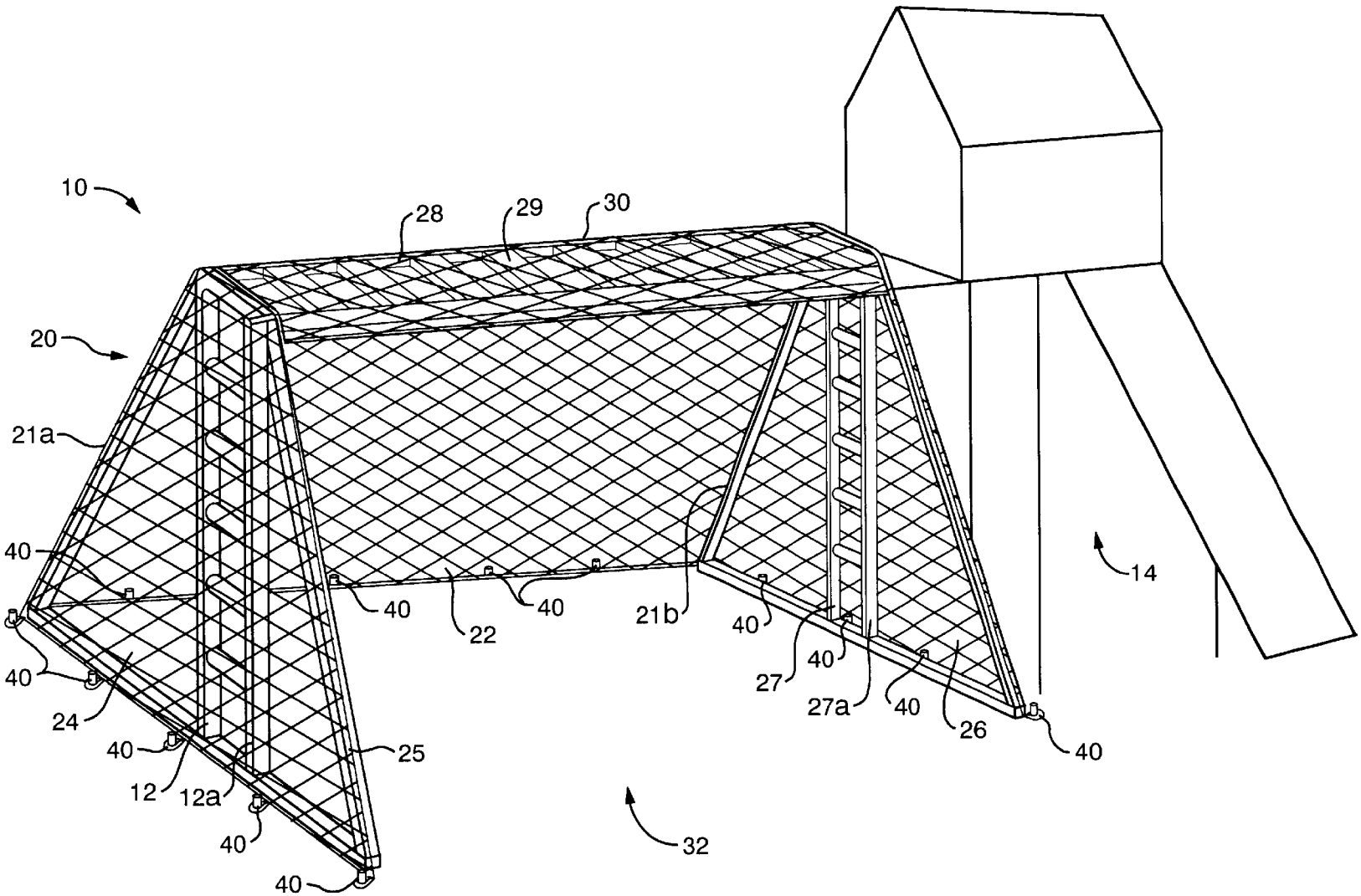
FIG. 1 is a schematic view of the net of the invention attached to a swing set having an additional play structure at one end thereof.

FIG. 1 illustrates a preferred embodiment of the net set of the invention, generally referred to as net set 20, attached to a swing set. The swing set shown in FIG. 1 comprises left side structure 12 (with ladder 12*a*), right side structure 27 (with ladder 27*a*) which are interconnected by top support structure 29 comprising two parallel beams, which in turn may be interconnected by perpendicular cross members which form an upper horizontal ladder member (monkey bars). The swing set also includes play structure 14 attached to side structure 27.

Together, net set 20 and the swing set form, and are generally referred to as, backstop 10. Net set 20 includes rectangular back section 20 interconnected along vertical side edge 21*a* to trapezoidal side section 24 and interconnected along vertical side edge 21*b* to trapezoidal side section 26. Side sections 24 and 26 are identical and are sized to cover generally the trapezoidal-shaped sides of a swing set and the open back of the swing set bounded by the trapezoidal-shaped sides. Net 20 also includes rectangular top piece 28 which is interconnected along horizontal top edge 30 of back section 22. Top piece 28 covers the top 29 of the swing set as shown in FIG. 1. This arrangement leaves open areas 34 and 36 (FIG. 3) between the ends of top 28 and the tops of side sections 24 and 26. This allowance enables the user to attach side sections 24 and 26 to the outside (FIG. 2A) or the inside (FIG. 2B) of side structures 12 or 27 of the swing set so that net 20 can be attached to a swing set which also has an auxiliary play structure, such as structure 14, attached to one or both ends of the swing set.

Net 20 is preferably made of standard plastic netting material, and each piece of netting is preferably reinforced along each edge, for example, by intertwining cording along the edges. Net 20 should have a weave that is tight enough to prevent a golf ball, or whatever other game ball is used, from passing through the net. For a golf ball, the openings in the weave should be less than about 1 to 1½ inches in diameter and/or in height and width depending on the shape of the openings.

Figure 2A:
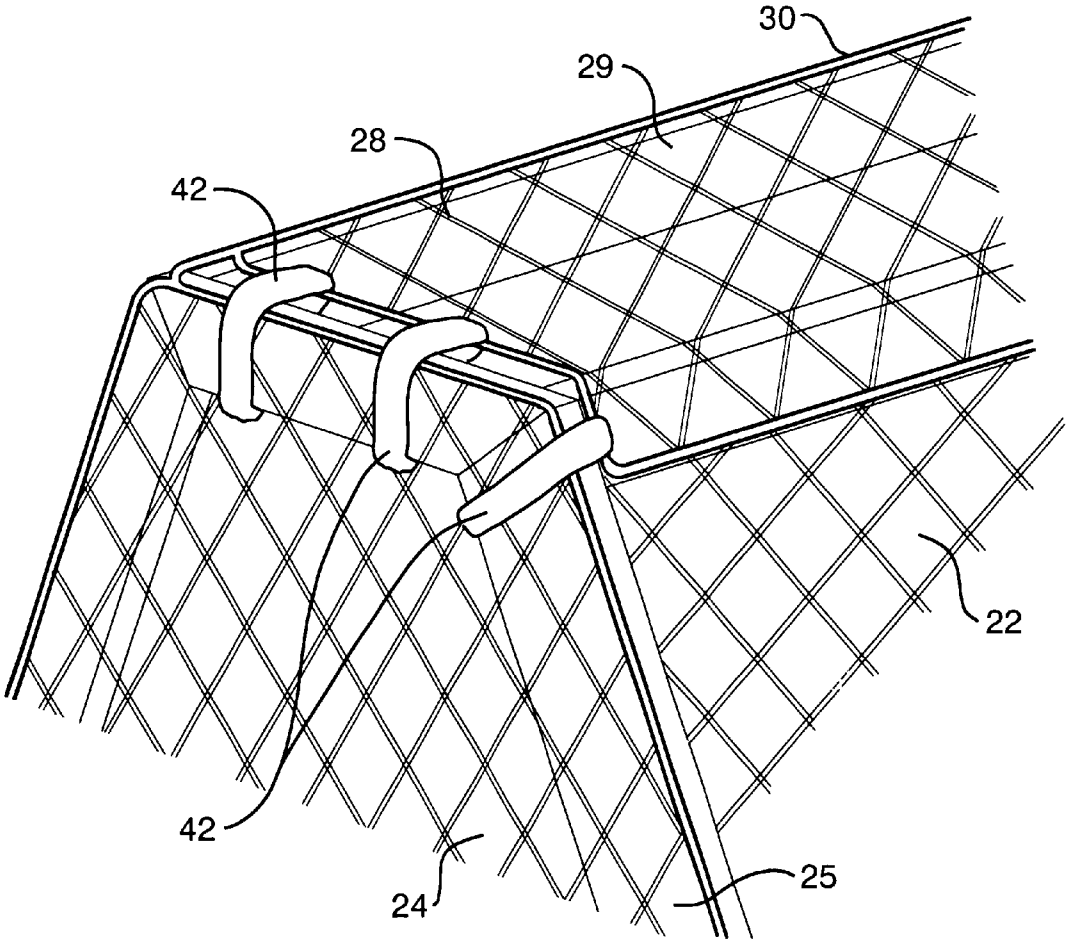
FIG. 2A is an enlarged partial view of the left-hand side of the net of FIG. 1 attached to the outside of the swing set as shown in FIG. 1.
Figure 2B:
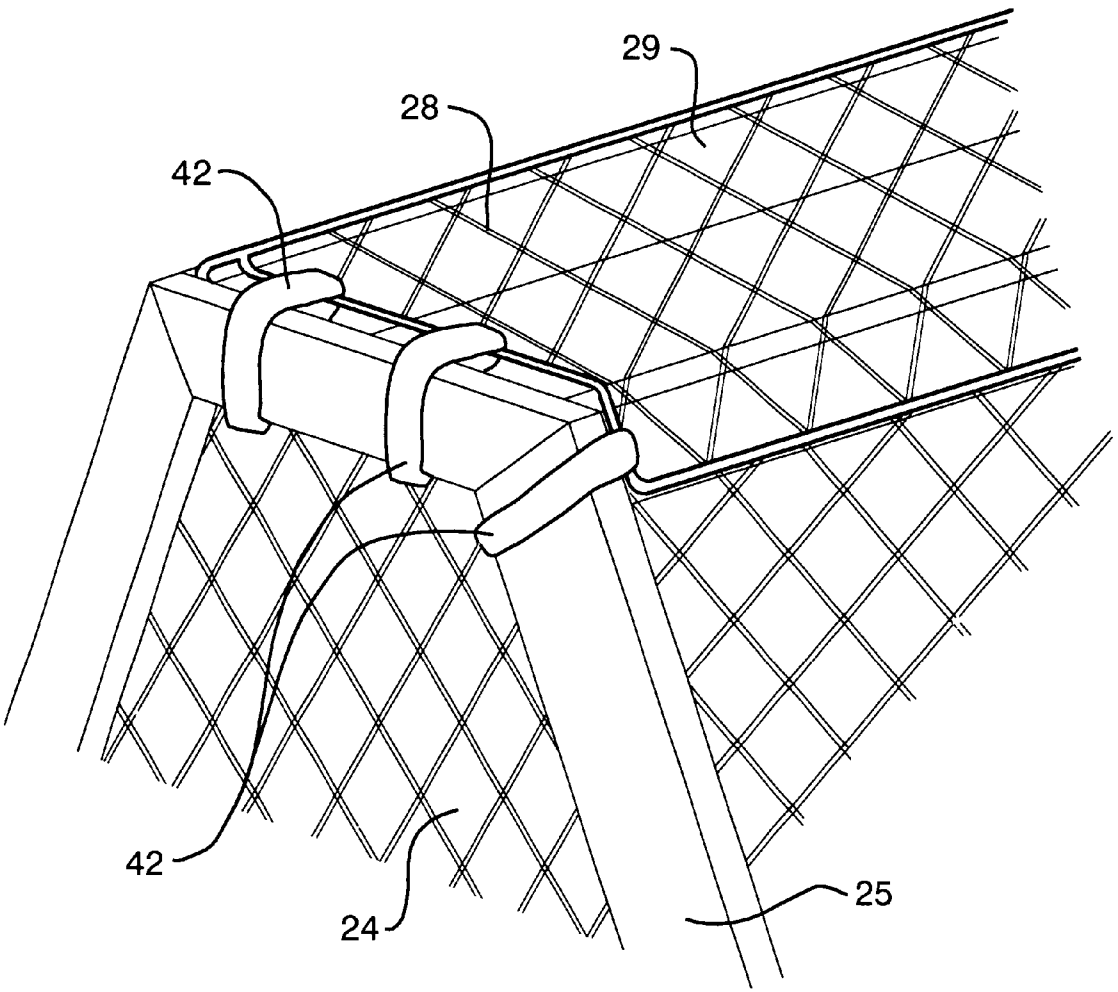
FIG. 2B is an enlarged partial view of the left-hand side of the net of FIG. 1 alternatively attached to the inside of the swing set of FIG. 1.
Figure 3:
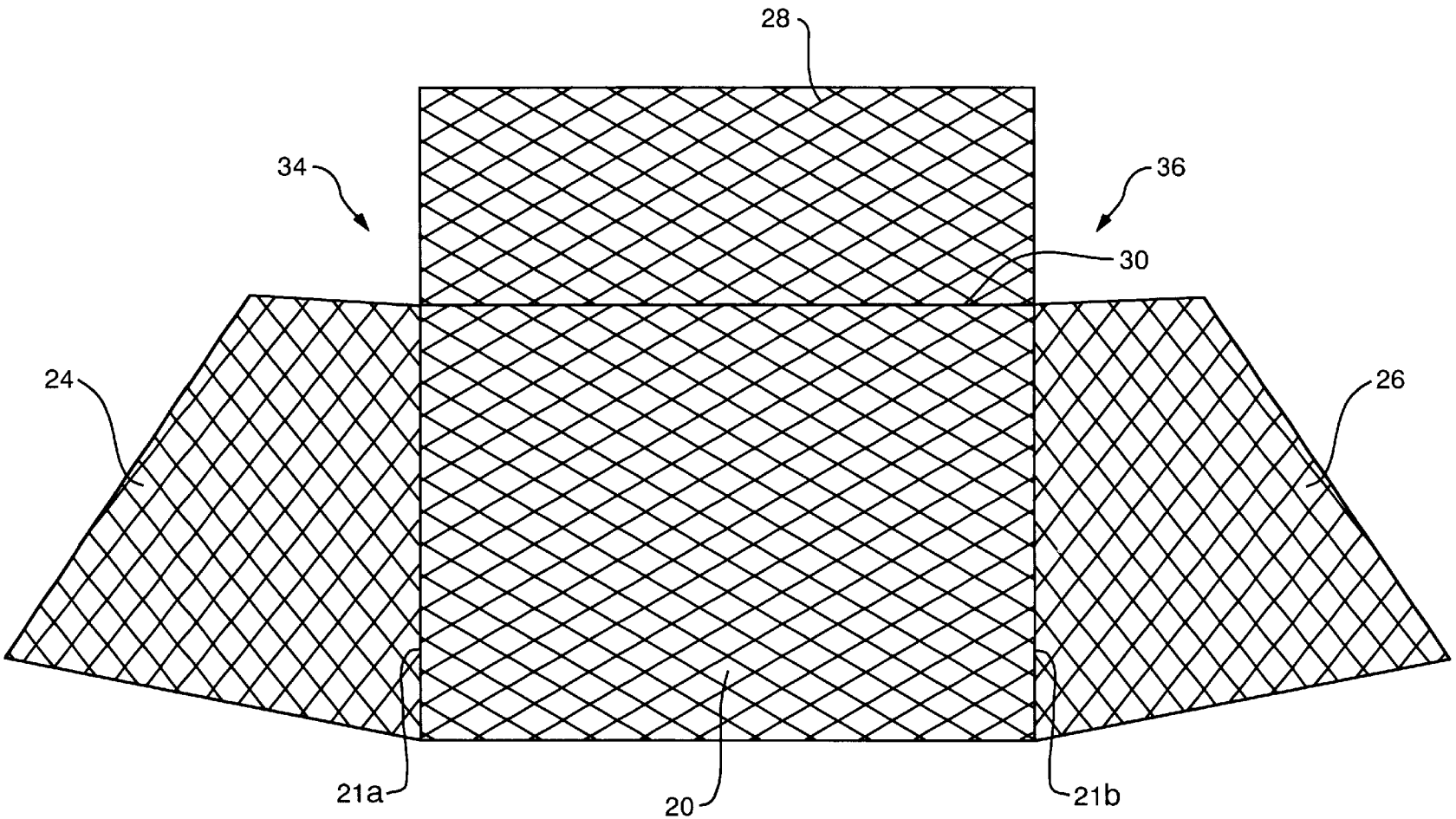
FIG. 3 is a front view of the net of FIG. 1 detached from the swing set of FIG. 1.

A plurality of standard tent-type stakes 40 are looped through the lower edges of net 20 and pushed into the ground to anchor net 20 in place on surface 20. Wraps or ties 42, FIGS. 2A and 2B, are use to attach the sides of net 20 to the top of side structures 12 and 27 of the swing set. Ties 42 are preferably made from rope, twine or a hook and loop material such as VELCRO. Together, stakes 40 and ties 42 attach net 20 to the swing set and the ground so that golf balls can be driven into the open front side of backstop 10.

The pieces of the invention are not necessarily limited in number or shape of the net set shown in the drawings. The number, shape and size of the net pieces will depend on the size and shape of the swing set. In addition, the net pieces are not limited to a plastic material and may be made completely or partially out of other suitable netting materials.

The preferred method of the invention for converting a swing set into a golf ball or other game ball back stop by attaching a net set to the swing set, is accomplished by providing a swing set comprising, a central support bar having two ends; and at least one side supports on each of the ends of the central support bar; providing a net set comprising, at least one back net piece with at least two substantially vertical side edges and one substantially horizontal top edge; at least two side net pieces each attached to the back piece along at least one of the side edges; at least one net top piece attached to the back piece along the top edge; and one or more means for removably attaching one or more of the net pieces to the swing set; attaching at least two of the side net pieces to the inside or outside of the side supports of the swing set using one or more of the means for removably attaching one or more of the net pieces to the swing set. The method may also include anchoring the net pieces to the ground by looping stakes through the lower edge of the net pieces and driving the stakes into the ground. If the swing set is located on a hard surface, such as concrete, anchors can be provided on the surface and the net pieces tied or strapped to the anchors.

Although specific features of the invention are shown in some drawings and not others, this is for convenience only as some feature may be combined with any or all of the other features in accordance with the invention.

Other embodiments will occur to those skilled in the art and are within the following claims:

What is claimed is:

1. A method for converting a swing set into a golf ball or other game ball backstop by attaching a net set to said swing set, comprises the steps of, providing a swing set comprising, a central support bar having two ends; and at least one side supports on each of said ends of said central support bar;

providing a net set comprising, at least one back net piece with at least two substantially vertical side edges and one substantially horizontal top edge;

at least two side net pieces each attached to the back piece along at least one of the side edges;

at least one net top piece attached to the back piece along the top edge;

and one or more means for removably attaching one or more of the net pieces to the swing set;

attaching at least two of said side net pieces to said side supports of said swing set using one or more of said means for removably attaching one or more of said net pieces to the swing set;

wherein said net pieces are adapted to prevent said golf ball or said game ball from passing through said net pieces.

* * * * *